US009789544B2

(12) United States Patent
Marya

(10) Patent No.: US 9,789,544 B2
(45) Date of Patent: Oct. 17, 2017

(54) METHODS OF MANUFACTURING OILFIELD DEGRADABLE ALLOYS AND RELATED PRODUCTS

(71) Applicant: SCHLUMBERGER TECHNOLOGY CORPORATION, Sugar Land, TX (US)

(72) Inventor: Manuel Marya, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 231 days.

(21) Appl. No.: 14/295,395

(22) Filed: Jun. 4, 2014

(65) Prior Publication Data

US 2014/0286810 A1 Sep. 25, 2014

Related U.S. Application Data

(60) Division of application No. 12/391,642, filed on Feb. 24, 2009, now Pat. No. 8,770,261, and a (Continued)

(51) Int. Cl.

| | |
|---|---|
| ***B22F 3/12*** | (2006.01) |
| ***C22C 1/04*** | (2006.01) |
| *B22F 3/24* | (2006.01) |

(52) U.S. Cl.

CPC ..... *B22F 3/12* (2013.01); *C22C 1/0416* (2013.01); *B22F 2003/242* (2013.01); *B22F 2003/248* (2013.01); *B22F 2998/10* (2013.01)

(58) Field of Classification Search

CPC ..... B22F 3/02; B22F 3/10; B22F 3/17

See application file for complete search history.

(56) References Cited

U.S. PATENT DOCUMENTS

| | | | |
|---|---|---|---|
| 2,261,292 | A | 11/1941 | Salnikov |
| 2,558,427 | A | 6/1951 | Fagan |

(Continued)

FOREIGN PATENT DOCUMENTS

| | | | |
|---|---|---|---|
| CN | 1141661 | A | 1/1997 |
| CN | 1416499 | A | 5/2003 |

(Continued)

OTHER PUBLICATIONS

Molyneux, Philip, "Water-soluble synthetic polymers: properties and behavior", CRC Press, vol. 1, 1983, 240 pages.

(Continued)

*Primary Examiner* — Jessee Roe
*Assistant Examiner* — Ngoclan T Mai
(74) *Attorney, Agent, or Firm* — Tuesday Kaasch

(57) ABSTRACT

A method of making a degradable alloy includes adding one or more alloying products to an aluminum or aluminum alloy melt; dissolving the alloying products in the aluminum or aluminum alloy melt, thereby forming a degradable alloy melt; and solidifying the degradable alloy melt to form the degradable alloy. A method for manufacturing a product made of a degradable alloy includes adding one or more alloying products to an aluminum or aluminum alloy melt in a mold; dissolving the one or more alloying products in the aluminum or aluminum alloy melt to form a degradable alloy melt; and solidifying the degradable alloy melt to form the product. A method for manufacturing a product made of a degradable alloy includes placing powders of a base metal or a base alloy and powders of one or more alloying products in a mold; and pressing and sintering the powders to form the product.

7 Claims, 8 Drawing Sheets

Related U.S. Application Data continuation-in-part of application No. 11/427,233, filed on Jun. 28, 2006, now Pat. No. 8,211,247.

(60) Provisional application No. 61/033,440, filed on Mar. 4, 2008, provisional application No. 60/746,097, filed on May 1, 2006, provisional application No. 60/771,627, filed on Feb. 9, 2006.

(56) References Cited

U.S. PATENT DOCUMENTS 2,779,136 A 1/1957 Hood et al.
2,809,891 A * 10/1957 Ennor ..... C22C 1/0416 148/513
3,106,959 A 10/1963 Huitt et al.
3,311,956 A 4/1967 Townsend
3,316,748 A 5/1967 Lang et al.
3,348,616 A 10/1967 Zingg
3,687,135 A 8/1972 Stroganov et al.
3,938,764 A 2/1976 McIntyre et al.
3,971,657 A * 7/1976 Daver ..... B01D 39/2034 419/2
4,157,732 A 6/1979 Fonner
4,270,761 A 6/1981 Hertz
4,450,136 A 5/1984 Dudek et al.
4,652,274 A 3/1987 Boettcher et al.
4,664,816 A 5/1987 Walker
4,735,632 A 4/1988 Oxman et al.
4,856,584 A 8/1989 Seidner
4,859,054 A 8/1989 Harrison
4,871,008 A 10/1989 Dwivedi et al.
4,898,239 A 2/1990 Rosenthal
4,903,440 A 2/1990 Kirk et al.
4,906,523 A 3/1990 Bilkadi et al.
4,919,209 A 4/1990 King
4,923,714 A 5/1990 Gibb et al.
5,057,600 A 10/1991 Beck et al.
5,178,646 A 1/1993 Barber, Jr. et al.
5,188,183 A 2/1993 Hopmann et al.
5,204,183 A 4/1993 McDougall et al.
5,236,472 A 8/1993 Kirk et al.
5,284,207 A 2/1994 Bittleston et al.
5,355,956 A 10/1994 Restarick
5,417,285 A 5/1995 Van Buskirk et al.
5,434,395 A 7/1995 Storck et al.
5,479,986 A 1/1996 Gano et al.
5,485,745 A 1/1996 Rademaker et al.
5,526,881 A 6/1996 Martin et al.
5,542,471 A 8/1996 Dickinson
5,566,757 A 10/1996 Carpenter et al.
5,573,225 A 11/1996 Boyle et al.
5,709,269 A 1/1998 Head
5,765,641 A 6/1998 Shy et al.
5,826,661 A 10/1998 Parker et al.
5,898,517 A 4/1999 Weis
5,944,123 A 8/1999 Johnson
5,965,826 A 10/1999 Von Bertrab
5,992,250 A 11/1999 Kluth et al.
6,009,216 A 12/1999 Pruett et al.
6,012,526 A 1/2000 Jennings et al.
6,024,158 A 2/2000 Gabathuler et al.
6,062,311 A 5/2000 Johnson et al.
6,079,281 A 6/2000 Oszajca et al.
6,145,593 A 11/2000 Hennig
6,155,348 A 12/2000 Todd
6,157,893 A 12/2000 Berger et al.
6,162,766 A 12/2000 Muir et al.
6,168,755 B1 1/2001 Biancaniello et al.
6,173,771 B1 1/2001 Eslinger et al.
6,192,983 B1 2/2001 Neuroth et al.
6,209,646 B1 4/2001 Reddy et al.
6,241,021 B1 6/2001 Bowling
6,247,536 B1 6/2001 Leismer et al.
6,261,432 B1 7/2001 Huber et al.
6,276,454 B1 8/2001 Fontana et al.
6,281,489 B1 8/2001 Tubel et al.
6,311,773 B1 11/2001 Todd et al.
6,346,315 B1 2/2002 Sawatsky
6,349,766 B1 2/2002 Bussear et al.
6,349,768 B1 2/2002 Leising
6,394,185 B1 5/2002 Constien
6,397,864 B1 6/2002 Johnson
6,419,014 B1 7/2002 Meek et al.
6,422,314 B1 7/2002 Todd et al.
6,444,316 B1 9/2002 Reddy et al.
6,457,525 B1 10/2002 Scott
6,474,152 B1 11/2002 Mullins et al.
6,494,263 B2 12/2002 Todd
6,519,568 B1 2/2003 Harvey et al.
6,527,051 B1 3/2003 Reddy et al.
6,531,694 B2 3/2003 Tubel et al.
6,534,449 B1 3/2003 Gilmour et al.
6,554,071 B1 4/2003 Crook et al.
6,561,270 B1 5/2003 Budde
6,581,455 B1 6/2003 Berger et al.
6,607,036 B2 8/2003 Ranson et al.
6,632,527 B1 10/2003 McDaniel et al.
6,667,280 B2 12/2003 Chang et al.
6,725,929 B2 4/2004 Bissonnette et al.
6,737,385 B2 5/2004 Todd et al.
6,745,159 B1 6/2004 Todd et al.
6,789,621 B2 9/2004 Wetzel et al.
6,817,410 B2 11/2004 Wetzel et al.
6,854,522 B2 2/2005 Brezinski et al.
6,866,306 B2 3/2005 Boyle et al.
6,877,563 B2 4/2005 Todd et al.
6,878,782 B2 4/2005 Merfeld et al.
6,896,056 B2 5/2005 Mendez et al.
6,896,058 B2 5/2005 Munoz, Jr. et al.
6,918,445 B2 7/2005 Todd et al.
6,924,254 B2 8/2005 Todd
6,956,099 B2 10/2005 Pavlin
6,966,368 B2 11/2005 Farquhar
6,968,898 B2 11/2005 Todd et al.
6,971,448 B2 12/2005 Slabaugh et al.
6,976,538 B2 12/2005 Wilson et al.
6,983,798 B2 1/2006 Todd
7,000,701 B2 2/2006 Todd et al.
7,021,383 B2 4/2006 Todd et al.
7,036,586 B2 5/2006 Roddy et al.
7,036,588 B2 5/2006 Munoz, Jr. et al.
7,036,687 B1 5/2006 Lowe
7,044,220 B2 5/2006 Nguyen et al.
7,093,664 B2 8/2006 Todd et al.
7,140,437 B2 11/2006 McMechan et al.
7,152,685 B2 12/2006 Adnan et al.
7,168,494 B2 1/2007 Starr et al.
7,182,134 B2 2/2007 Wetzel et al.
7,207,216 B2 4/2007 Meister et al.
7,285,772 B2 10/2007 Labous et al.
7,322,412 B2 1/2008 Badalamenti et al.
7,322,417 B2 1/2008 Rytlewski et al.
7,353,867 B2 4/2008 Carter et al.
7,353,879 B2 4/2008 Todd et al.
7,581,590 B2 9/2009 Lesko et al.
7,617,873 B2 11/2009 Lovell et al.
7,726,406 B2 6/2010 Xu
8,211,247 B2 7/2012 Marya et al.
8,220,554 B2 7/2012 Jordan et al.
8,663,401 B2 3/2014 Marya et al.
2002/0004060 A1 1/2002 Heublein et al.
2002/0007945 A1 1/2002 Neuroth et al.
2002/0017386 A1 2/2002 Ringgenberg et al.
2002/0125008 A1 9/2002 Wetzel et al.
2003/0070811 A1 4/2003 Robison et al.
2003/0116608 A1 6/2003 Litwinski
2003/0150614 A1 8/2003 Brown et al.
2003/0224165 A1 12/2003 Anderson et al.
2004/0040707 A1 3/2004 Dusterhoft et al.
2004/0043906 A1 3/2004 Heath et al.
2004/0045705 A1 3/2004 Gardner et al.
2004/0084190 A1 5/2004 Hill et al.
2004/0129418 A1 7/2004 Jee et al.
2004/0188090 A1 9/2004 Vaeth et al.

(56) References Cited

U.S. PATENT DOCUMENTS

| | | | |
|---|---|---|---|
| 2005/0016730 | A1 | 1/2005 | McMechan et al. |
| 2005/0121192 | A1 | 6/2005 | Hailey, Jr. et al. |
| 2005/0126777 | A1 | 6/2005 | Rolovic et al. |
| 2005/0145308 | A1 | 7/2005 | Sailer et al. |
| 2005/0145381 | A1 | 7/2005 | Pollard |
| 2005/0161222 | A1 | 7/2005 | Haugen et al. |
| 2005/0173126 | A1 | 8/2005 | Starr et al. |
| 2005/0189103 | A1 | 9/2005 | Roberts et al. |
| 2005/0194141 | A1 | 9/2005 | Sinclair et al. |
| 2005/0205264 | A1 | 9/2005 | Starr et al. |
| 2005/0205265 | A1 | 9/2005 | Todd et al. |
| 2005/0205266 | A1 | 9/2005 | Todd et al. |
| 2005/0241824 | A1 | 11/2005 | Burris et al. |
| 2005/0241825 | A1 | 11/2005 | Burris, II et al. |
| 2005/0241835 | A1 | 11/2005 | Burris et al. |
| 2005/0269083 | A1 | 12/2005 | Burris et al. |
| 2006/0027359 | A1 | 2/2006 | Carter et al. |
| 2006/0034724 | A1 | 2/2006 | Hamano et al. |
| 2006/0035074 | A1 | 2/2006 | Taylor |
| 2006/0037759 | A1 | 2/2006 | Braddick |
| 2006/0042835 | A1 | 3/2006 | Guerrero et al. |
| 2006/0044156 | A1 | 3/2006 | Adnan et al. |
| 2006/0175059 | A1 | 8/2006 | Sinclair et al. |
| 2006/0207771 | A1 | 9/2006 | Rios et al. |
| 2006/0249310 | A1 | 11/2006 | Stowe et al. |
| 2006/0266551 | A1 | 11/2006 | Yang et al. |
| 2007/0034384 | A1 | 2/2007 | Pratt |
| 2007/0044958 | A1 | 3/2007 | Rytlewski et al. |
| 2007/0107908 | A1 | 5/2007 | Vaidya et al. |
| 2007/0137860 | A1 | 6/2007 | Lovell et al. |
| 2007/0181224 | A1 | 8/2007 | Marya et al. |
| 2008/0018230 | A1 | 1/2008 | Yamada et al. |
| 2008/0029303 | A1 | 2/2008 | Codazzi et al. |
| 2008/0066924 | A1 | 3/2008 | Xu |
| 2008/0079485 | A1 | 4/2008 | Taipale et al. |
| 2008/0105438 | A1 | 5/2008 | Jordan et al. |
| 2008/0141826 | A1 | 6/2008 | Marya et al. |
| 2008/0149345 | A1 | 6/2008 | Marya et al. |
| 2008/0149351 | A1 | 6/2008 | Marya et al. |
| 2008/0236842 | A1 | 10/2008 | Bhavsar et al. |
| 2009/0025940 | A1 | 1/2009 | Rytlewski |
| 2009/0050334 | A1 | 2/2009 | Marya et al. |
| 2009/0126945 | A1 | 5/2009 | Sharma et al. |
| 2009/0151936 | A1 | 6/2009 | Greenaway |
| 2009/0151949 | A1 | 6/2009 | Marya et al. |
| 2009/0226340 | A1 | 9/2009 | Marya |
| 2009/0242189 | A1 | 10/2009 | Vaidya et al. |
| 2009/0301733 | A1 | 12/2009 | Shuster et al. |
| 2010/0012708 | A1 | 1/2010 | Steward et al. |
| 2010/0018703 | A1 | 1/2010 | Lovell et al. |
| 2010/0051275 | A1 | 3/2010 | Lewis et al. |
| 2010/0209288 | A1 | 8/2010 | Marya |
| 2010/0212907 | A1 | 8/2010 | Frazier |
| 2010/0252273 | A1 | 10/2010 | Duphorne |
| 2010/0270031 | A1 | 10/2010 | Patel |
| 2011/0048743 | A1 | 3/2011 | Stafford et al. |
| 2011/0067889 | A1 | 3/2011 | Marya et al. |

FOREIGN PATENT DOCUMENTS

| | | | |
|---|---|---|---|
| CN | 101326340 | A | 12/2008 |
| DE | 2818656 | A1 | 10/1979 |
| DE | 29816469 | | 12/1998 |
| EP | 203249 | A2 | 3/1986 |
| EP | 178334 | B1 | 7/1990 |
| EP | 853249 | A1 | 7/1998 |
| EP | 0854439 | A2 | 7/1998 |
| EP | 1051529 | | 11/2000 |
| EP | 1605281 | B1 | 5/2006 |
| GB | 666281 | A | 2/1952 |
| GB | 1187305 | A | 4/1970 |
| GB | 2177231 | | 1/1987 |
| GB | 2275953 | | 9/1994 |
| GB | 2386627 | A | 9/2003 |
| GB | 2432377 | A | 5/2007 |
| GB | 2435046 | A | 8/2007 |
| GB | 2457207 | A | 8/2009 |
| GB | 2458557 | A | 9/2009 |
| GB | 2459783 | A | 11/2009 |
| GB | 2467090 | | 7/2010 |
| JP | 06228694 | | 8/1994 |
| JP | 11264042 | A | 9/1999 |
| JP | 2002161325 | A | 6/2002 |
| RU | 2015187 | C1 | 6/1994 |
| RU | 2073696 | C1 | 2/1997 |
| RU | 2078899 | | 5/1997 |
| RU | 2122628 | | 11/1998 |
| RU | 2149247 | | 5/2000 |
| RU | 46031 | U1 | 6/2005 |
| RU | 52996 | U1 | 4/2006 |
| RU | 2296217 | | 3/2007 |
| RU | 2421498 | | 6/2011 |
| SU | 358864 | A | 5/1966 |
| SU | 337425 | | 5/1972 |
| SU | 349746 | | 9/1972 |
| SU | 1585079 | A1 | 8/1990 |
| SU | 1733617 | A1 | 5/1992 |
| WO | W09903515 | | 1/1999 |
| WO | W00161146 | | 8/2001 |
| WO | 0248503 | A1 | 6/2002 |
| WO | 2005090742 | A1 | 9/2005 |
| WO | 2006023172 | A2 | 3/2006 |
| WO | 2008068645 | A1 | 6/2008 |
| WO | 2008079485 | A2 | 7/2008 |
| WO | 2008079486 | A1 | 7/2008 |
| WO | W02008112260 | A1 | 9/2008 |
| WO | 2008079485 | A3 | 11/2008 |
| WO | W02009048822 | | 4/2009 |
| WO | 2009064662 | A1 | 5/2009 |

OTHER PUBLICATIONS

Thomson, et al., "Design and Installation of a Cost-Effective Completion System for Horizontal Chalk Wells Where Multiple Zones Require Acid Stimulation", SPE 51177—SPE Drilling and Completion, vol. 13(3), 1998, pp. 151-156.

Examination Report issued in United Kingdom Application No. GB1009287.2 on Jul. 21, 2011.

Office action issued in the related Ar application 20090100760 (68.0850-Ar-Np, dated Jul. 05, 2016 (3 pp.).

Office action issued in the related RU Application 2009107632 dated Jul. 26, 2013 (28 pages).

Decision of Grant issued in the related RU Application 2009107632 dated Feb. 28, 2013 (21 pages).

Answers.com, "Degrade: Definition, Synonyms", <http://www.answers.com/topic/degrade>, Retrieved from the Internet, May 11, 2011.

Marya Manual P. Office action issued in the related U.S. Appl. No: 11/769,230, dated Oct. 29, 2008.

Marya Manual P. Office action issued in the related U.S. Appl. No: 11/427233, dated Jul. 24, 2009.

Examination report issued in the related CA application 2573471, dated Mar. 4, 2014 (4 pages).

Examination report issued in the related CA application 2573471, dated Mar. 19, 2013 (5 pages).

Examination report issued in the related CA application 2573471, dated Nov. 4, 2014 (4 pages).

Examination report issued in the related CA application 2573471, dated Jul. 20, 2015 (3 pages).

Examination report issued in the related CA application 2573471, dated Jul. 21, 2016 (3 pages).

Examination report issued in the related CA application 2705321, dated Nov. 28, 2014 (3 pages).

Examination report issued in the related CA application 2705321, dated Aug. 11, 2015 (3 pages).

Office action issued in the related EG application PCT787/2010, dated Apr. 7, 2014 (1 page) .

Search Report issued in the related GB application 0700919.4 dated May 10, 2007 (2 pages).

(56) References Cited

OTHER PUBLICATIONS

Decision of grant issued in the related RU application 2013110514, dated Jan. 16, 2015 (14 pages).
Examination report issued in the related GC application GCC/P/2007/7739, dated Feb. 15, 2013 (11 pages).
Office action issued in the related ID application P-00200700052, dated Apr. 5, 2017 (3 pages).
Office action issued in the related MX application MX/a/2010/005216, dated Mar. 1, 2013 (5 pages).
Office action issued in the related RU application 2010124372, dated Oct. 18, 2012 (12 pages).
International Search Report and written opinion issued in the related PCT application PCT/US2011/047296, dated Feb. 10, 2012 (13 pages).
International Preliminary Report on patentability issued in the related PCT application PCT/US2011/047296, dated Feb. 12, 2013 (9 pages).
Bishop, et al., "Solubility and properties of a poly(aryl ether ketone) in strong acids", Macromolecules, vol. 18, No. 1, 1985, pp. 86-93.
Lakshmi, et al., "Sulphonated poly(ether ether ketone): Synthesis and characterisation", Journal of Materials Science, vol. 40, No. 3, Feb. 2005, pp. 629-636.
Merriam-Webster Dictionary, "Tapered", Definition of tapered, Merriam-Webster; http://www.merriam-webster.com/dictionary/tapered.
Reyna-Valencia, et al., "Structural and mechanical characterization of poly(ether ether ketone) (PEEK) and sulfonated PEEK films: Effects of thermal history, sulfonation, and preparation conditions", Journal of Applied Polymer vol. 99, No. 3, Feb. 5, 2006, pp. 756-774.
Roovers, et al., "Synthesis and characterization of narrow molecular-weight distribution fractions of poly(aryl ether ether ketone)", Macromolecules, vol. 23, No. 6, 1990, pp. 1611-1618.
Wolfbeis, etal, Fiber Optic Fluorosensor for Oxygen and Carbon Dioxide, Anal. Chem, vol. 60.
Wang, et al., "Synthesis and molecular characterization of narrow molecular weight distribution fractions of methyl-substituted poly(aryl ether ether ketone)", Macromolecules, vol. 26, No. 15, 1993, pp. 3826-3832.
Wei-Berk, et al., "Studies on dilute solutions of phenyl ether ketone copolymers", Journal of Polymer Science Part B: Polymer Physics, vol. 28, No. 10, Sep. 1990, pp. 1873-1879.
Balanyuk, "Mossbauer study and thermodynamic modeling of Fe-C-N. alloy", Acta Materialia, vol. 48, No. 15, Sep. 2000, pp. 3813-3821.
Gavriljuk, et al., "Nitrogen and Carbon in Austenitic and Martensitic Steels: Atomic Interactions and Structural Stability", Materials Science Forum, vols. 426-432, Part 2, 2003, pp. 943-950.
Jargelius-Pettersson, R.F.A., "Application of the Pitting Resistance Equivalent Concept to Some Highly Alloyed Austenitic Stainless Steels", Corrosion (USA), vol. 54, No. 2, Feb. 1998, pp. 162-168.
Rawers, "Characterizing alloy additions to carbon high-nitrogen steel", Proceedings of the Institution of Mechanical Engineers, Part L: Journal of Materials: Design and Applications, vol. 218 , No. 3, Aug. 2004, pp. 239-246.
Eslinger, et al., A Hybrid Milling/Jetting Tool—The Safe Solution to Scale Milling, SPE 60700—SPE/ICoTA Coiled Tubing Roundtable, Houston, Texas.
Esteban, et al., Measurement of the Degree of Salinity of Water with a Fiber-Optic Sensor, Applied Optics, vol. 38(25).
Johnson et al., An Abrasive Jetting Scale Removal System, SPE 46026—SPE/IC0TA Coiled Tubing Roundtable, Houston, Texas.
Office action issued in the related RU application 2013110514, dated Apr. 22, 2014 (9 pages).
Office action issued in the related CN application 2015010901013760, dated Sep. 9, 2015 (13 pages).
Office action issued in the related CN application 2015010901013760, dated Jan. 14, 2015 (30 pages).
Office action received in the related CA application 2808081, dated Jan. 15, 2014 (3 pages).
International Preliminary Report on Patentability issued in the related PCT application PCT/US2008/082713, dated May 18, 2010 (6 pages).
International Search Report and written opinion issued in the related PCT application PCT/US2008/082713, dated Mar. 13, 2009 (7 pages).
Office action issued in the related RU application 2010124372, dated Apr. 29, 2015 (10 pages).
Office action issued in the related RU application 2010124372, dated Jan. 24, 2014 (9 pages).
Office action issued in the related RU application 2010124372, dated Mar. 21, 2013 (12 pages).

* cited by examiner (1) CONSTANT PROPERTY (ZERO GRADIENT)
(2),(3) LINEARLY DECREASING / INCREASING PROPERTY (CONSTANT GRADIENT)
(4) PROPERTY CHANGE MARKED BY DISCONTINUITIES
(5) MISCELLANEOUS

METHODS OF MANUFACTURING OILFIELD DEGRADABLE ALLOYS AND RELATED PRODUCTS

CROSS-REFERENCE TO RELATED APPLICATIONS

The present application is a divisional of U.S. patent application Ser. No. 12/391,642, filed Feb. 24, 2009, now U.S. Pat. No. 8,770,261, published as U.S. Patent Publication No. 2009-0226340, which claims priority to U.S. Provisional Application Ser. No. 61/033,440, filed on Mar. 4, 2008, and which is a continuation-in-part of U.S. patent application Ser. No. 11/427,233, filed Jun. 28, 2006, now U.S. Pat. No. 8,211,247, and claims the benefit of U.S. Provisional Application Ser. No. 60/746,097, filed on May 1, 2006, and U.S. Provisional Application Ser. No. 60/771,627, filed on Feb. 9, 2006, all of which are incorporated by reference herein in their entirety.

BACKGROUND

Technical Field

The present application relates generally to the field of manufacturing with novel degradable metallic materials, such as degradable alloys of aluminum, and methods of making products of degradable alloys useful in oilfield exploration, production, and testing.

Background Art

To retrieve hydrocarbons from subterranean reservoirs, wells of a few inches wide and up to several miles long are drilled, tested to measure reservoir properties, and completed with a variety of tools. In drilling, testing, and completing a well, a great variety of tools are deployed down the wellbore (downhole) for a multitude of critical applications. Many situations arise where degradable materials (e.g. materials with an ability to decompose over time) may be technically and economically desirable; for instance an element (i.e., a tool or the part of a tool) that may be needed only temporarily and would require considerable manpower for its retrieval after becoming no longer useful may be conveniently made of a degradable material. If such element is designed (formulated) to degrade within a variety of wellbore conditions after it has served its functions, time and money may be saved. A chief pre-requirement to the industrial use and oilfield use of degradable materials is their manufacturability. In contrast to plastic and polymeric materials, many among which may degrade in a wellbore environment (e.g. polylactic acid in water), metallic materials (e.g., alloys) have typically much greater mechanical strengths, and mechanical strength is necessary to produce oilfield elements that may withstand the high pressure and temperatures existing downhole.

Various degradable metallic materials have been recently disclosed by the same inventors (Marya et al.). For example, U.S. 2007/0181224 by Marya et al. discloses compositions (i.e., materials of all sort: metals, alloys, composites) comprising one or more reactive metals in a major proportion and one or more alloying products in a minor proportion. The compositions are characterized as being of high-strength and being controllably reactive and degradable under defined conditions. The compositions may contain reactive metals selected from products in columns I and II of the Periodic Table and alloying products, such as gallium (Ga), indium (In), zinc (Zn), bismuth (Bi), and aluminum (Al). Oilfield products made from these compositions may be used to temporarily separate fluids from a multitude of zones. Upon completion of their intended functions, the oilfield products may either be fully degraded, or may be forced to fall or on the contrary float to a new position without obstructing operations.

Similarly, U.S. 2008/0105438 discloses the use of high-strength, controllably reactive, and degradable materials to specifically produce oilfield whipstocks and deflectors.

U.S. 2008/0149345 discloses degradable materials, characterized as being smart, for use in a large number of downhole elements. These elements may be activated when the smart degradable materials are degraded in a downhole environment. The smart degradable materials may include alloys of calcium, magnesium, or aluminum, or composites of these materials in combination with non-metallic materials such as plastics, elastomers, and ceramics. The degradation of the smart degradable materials in fluids such as water may result in at least one response that, in turn, triggers other responses, e.g., opening or closing a device, or sensing the presence of particular water-based fluids (e.g. formation water).

Because degradable metallic materials (namely alloys) are useful for a variety of oilfield operations, methods of manufacturing oilfield products made of these degradable materials are highly desirable.

SUMMARY

A method in accordance with one embodiment includes adding one or more alloying products to an aluminum or aluminum alloy melt; dissolving the alloying products in the aluminum or aluminum alloy melt, thereby forming a degradable alloy melt; and solidifying the degradable alloy melt to form the degradable alloy.

Another aspect relates to methods for manufacturing a product made of a degradable alloy. A method in accordance with one embodiment includes adding one or more alloying products to an aluminum or aluminum alloy melt in a mould; dissolving the one or more alloying products in the aluminum or aluminum alloy melt to form a degradable alloy melt; and solidifying the degradable alloy melt to form the product.

Another aspect relates to methods for manufacturing a product made of a degradable alloy. A method in accordance with one embodiment includes placing powders of a base metal or a base alloy and powders of one or more alloying products in a mould; and pressing and sintering the powders to form the product.

Other inventive aspects and advantages will be apparent from the following description and the appended claims.

BRIEF DESCRIPTION OF DRAWINGS

FIG. 5A shows the gallium-lithium (Ga—Li) phase diagram; FIG. 5B shows the gallium-magnesium (Ga—Mg) phase diagram; FIG. 5C shows the gallium-nickel (Ga—Ni) phase diagram; and FIG. 5D shows the gallium-zinc (Ga—Zn) phase diagram. Under slow heating and slow cooling conditions (i.e., equilibrium), these phase diagrams reveal useful information such as the mutual solubilities of the various phases as well as the variations of the melting temperature (liquidus) as a function of chemical binary mixtures. FIGS. 5A-5D are prior-art diagrams that not only provide some insight on the challenges of manufacturing with degradable alloys but also help identify useful alloys for degradable alloys and preformed additives.

DETAILED DESCRIPTION

Figure 1:
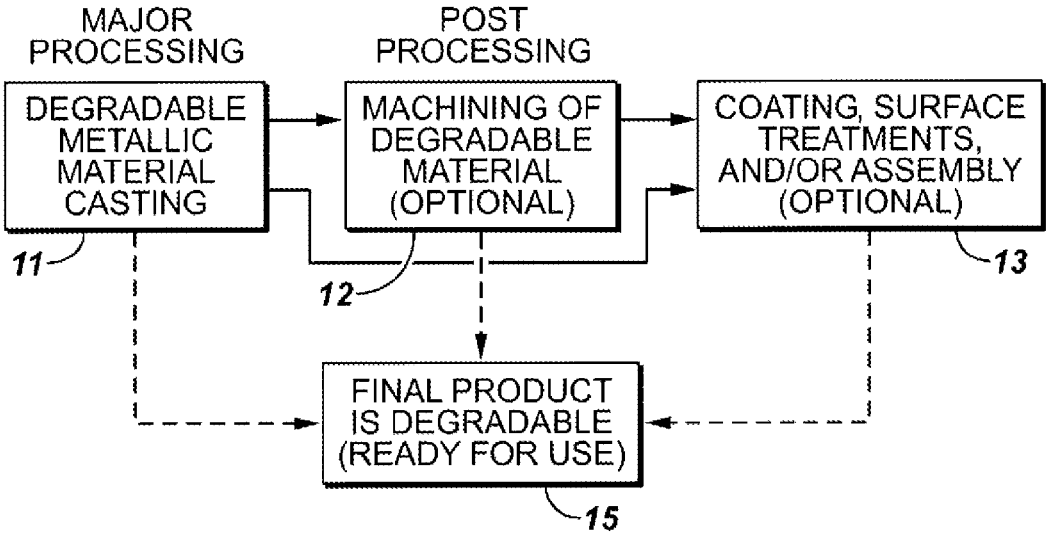
FIG. 1 shows a method for manufacturing a product made of a degradable alloy in accordance with embodiments. A number of embodiments apply to the casting process referred in FIG. 1.

The following detailed description describes a number of preferred embodiments. The described embodiments are meant to help provide an understanding of the claimed subject matter to one skilled in the art and are not meant to unduly limit the present or future scope of any claims associated with the present application.

Embodiments relate to methods of making degradable alloys and elements (e.g., downhole tools and parts of tools) made at least partially (if not entirely) of one of more degradable alloys. In accordance with embodiments, such degradable alloys are based on aluminum, meaning that aluminum metal (e.g. commercial purity aluminum) or an aluminum alloy (e.g. cast and wrought commercial grades) is the "base metal" and selected "alloying products" are introduced therein such that the resultant material may be characterized as an alloy that is degradable under selected conditions (e.g. water at elevated temperature). In accordance with embodiments, such degradable alloys may be dissolved, fragmented, and/or disintegrated in a controlled manner, for example, by exposure to a fluid (e.g., water) within a selected period of time (e.g., minutes, hours, weeks). By definition, the rates of degradation of these degradable alloys and products are orders of magnitude greater than the rates at which commercial materials like pure aluminum or for instance a 6061 aluminum grade would degrade by a corrosion process. For example, some of these degradable alloys may be fully degraded in cold water even at neutral hydrogen potential (i.e., pH=7.0) whereas aluminum and aluminum alloys would not degrade in a like environment. In fact, at any pH values the degradable alloys useful in connection with embodiments also degrade significantly faster than any commercial aluminum, and that is why they are referred as being degradable alloys (note than commercial aluminum and aluminum alloys slowly degrade in highly acidic and highly basic fluids).

Inventive embodiments relate to novel alterations of known methods used in the manufacture of metal products, such as casting, forming, forging, and powder-metallurgy techniques (e.g., sintering, hot-isostatic pressing). Embodiments are applicable far beyond the oil and gas industry and most generally apply to manufactured products of degradable alloys. One skilled in the art would appreciate that these examples are for illustration only and are not intended to unnecessarily limit the present or future claim scope.

Embodiments are particularly suitable for fabricating degradable alloys with unique properties for use in downhole environments or for manufacturing degradable oilfield elements, such as those listed next. In addition, embodiments may include applications of welding, coating, and surface treatment processes, among any other prior-art processes, to manufacture products made of degradable alloys.

Examples of oilfield products that may be made of degradable alloys include:

- Actuators intended to activate other mechanisms that may be as simple as compression springs (e.g., energized packer element or production packer slips, anchoring release devices, etc).
- Sensors, for instance intended to detect the presence of a water-based fluid (liquid, water vapor, acids, bases, etc). Upon sensing the presence of water for instance, a system response is triggered such as a mechanical response (spring or any other displacement, or a fluid flow) or an electronic response, among others.
- Disposable elements (i.e., tools and parts of tools) such as shaped charges, perforating guns, including tubing-conveyed applications, and darts, plugs, etc, that upon degrading leaves no consequential debris. Also included among disposable elements are hollow components with degradable plugs/caps/sealing products; e.g. liners, casing.
- Collapse-resistant degradable frac fluids additives and proppants. Also included are well intervention pills, capsules, etc.

In accordance with embodiments, degradable alloys may be based on any common aluminum and aluminum alloys; in this description these common metals and alloys are also referred to as "base metals" or "base alloys" because they are non-degradable. Aluminum and its alloys are indeed not considered to be degradable under either normal or the desired conditions; e.g., they would take years to fully degrade in a downhole formation water, whereas the degradable aluminum alloys in accordance with embodiments may fully degrade within minutes to weeks, depending upon their selected chemical compositions, internal structures (e.g. a graded structure exhibiting compositional gradients), among other factors. These non-degradable base metals or alloys of aluminum may be mixed with selected "alloying products" or additives, such as gallium (Ga), mercury (Hg, even though mercury is highly hazardous and its use should be restricted), indium (In), bismuth (Bi), tin (Sb), lead (Pb), antimony (Sb), thallium (Tl), etc., to create a new materials (alloys) that are degradable under certain conditions (e.g. water at a specific temperature). It is to be noted that rarely is a single alloying element effective in producing a degradable alloy. Appropriate combinations of several alloying elements are normally required to balance several properties: e.g., rate of degradation, strength, impact resistance, density in addition to cost and manufacturability. Additives are therefore generally complex mixtures of a variety of the cited elements, among others not listed in this application.

For specific examples of degradable alloys, see the examples disclosed in U.S. Published Application No. 2007/0181224 A1. Some examples of degradable alloys include calcium-lithium (Ca—Li), calcium-magnesium (Ca—Mg), calcium-aluminum (Ca—Al), calcium-zinc (Ca—Zn), and magnesium-lithium (Mg—Li) alloys enriched with tin (Sn), bismuth (Bi) or other low-solubility alloying products (e.g. lead, Pb).

However, of these mentioned degradable alloys, the present application applies exclusively to degradable alloys that possess aluminum as their main constituent; i.e., these alloys are degradable aluminum alloys. Among these alloys may be cited for examples those of aluminum-gallium (Al—Ga), aluminum-indium (Al—In), as well as more complex alloying compositions; e.g. aluminum-gallium-indium (Al—Ga—In), aluminum-gallium-bismuth-tin (Al—Ga—Bi—Sn) alloys. The alloys useful to present inventive embodiments may be considered to be environmentally-friendly (with exception of those having hazardous elements like mercury or lead for instance,) easy to manufacture (e.g. they may be air-melted), and may be produced by conventional techniques provided only a few modifications that are object present inventive embodiments and are intended to facilitate manufacturing and improve alloy quality, among others.

These degradable alloys of aluminum are mechanically strong, impact resistant, and are degradable in a variety of conditions, such as when water is present. For example, some of the degradable aluminum alloys may degrade in completion brines, formation waters regardless of pH, within a matter of minutes in extreme cases, as well as dilute acids, bases, and hydrocarbon-water mixtures. Therefore, these degradable alloys may be utilized to make oilfield elements that are designed to serve temporary functions. Upon completion of their functions, such oilfield products may be degraded in the wellbore environment, thus eliminating the need for their retrieval. Consequently considerable cost advantages may result from the use of such degradable materials.

FIG. 1 presents a flow chart pointing out various methods for manufacturing an oilfield product in accordance with preferred embodiments. In a straight-forward approach, a method may use casting (molding) to produce the desired products (11). In accordance with this method, non-degradable metals and alloys may be mixed and melted with additives and the resulting melt may be poured into a mould (die) that has the final or near-final shape of the desired product along with the one or several chemical compositions of a degradable alloy. Thus, the product from casting is a suitable final product (15) that is degradable.

Alternatively, the initial cast products (11) may be subjected to further process treatments such as machining of the initial products (12) to reshape the initial products into the final desired products (15). Similarly, the initial product (11) may be subjected to coating, surface treatment and/or assembly (13) processes in order to afford the final products (15). In accordance with some embodiments, the initial products (11) may be subjected to machining (12) and coating processes, surface treatments, and/or assembly processes (13) to arrive at the final products (15).

The table below presents examples of downhole oilfield products with suitable methods and processes to manufacture them:

| Tubular Shapes (degradable) pipes, tubes, gun carriers, etc. | Non-Tubular Shapes (degradable) Plugs, darts, shaped-Dart/TAP plugs, shape charge cases, etc. |
|---|---|
| Centrifugal casting<br>Flow forming, Extrusion forming, Pilgrim<br>Powder metallurgy and combination thereof (e.g. casting and HIP) | Casting<br>Forming and forging<br>Powder metallurgy |

Figure 2:
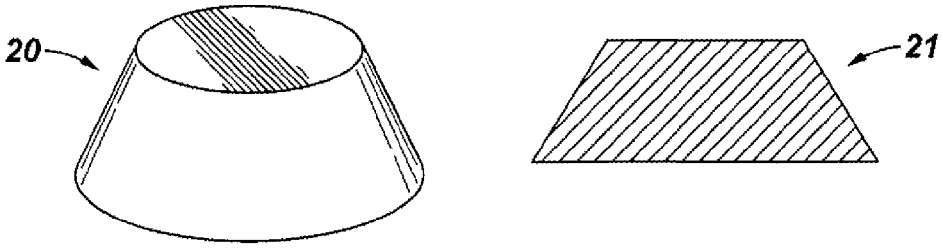
FIG. 2 shows an example of a conical cast object made of a novel degradable aluminum alloy in accordance with one embodiment. The shown cast object contained gallium (Ga), indium (In), and zinc (Zn); three metals that were precisely added via a performed additive. The alloying was injected in a pure aluminum melt at 650° C. and resulted in the shown degradable alloy object.

FIG. 2 shows a photograph of a water-degradable product that is manufactured using a preferred method. As shown, a conical object 20 with trapezoidal cross section 21 is made of a degradable aluminum alloy in accordance with embodiments. Additives were introduced in the melt to transform a commercial 60661 alloy melt into a degradable alloy, in accordance with embodiments. The conical object 20 may be used as downhole tube plug, among other possible applications.

As exemplified in the Table above, various oilfield elements (i.e., device or parts) may be manufactured using degradable alloys and methods, including casting, forming, forging and powder metallurgy techniques.

Casting

Figure 3:
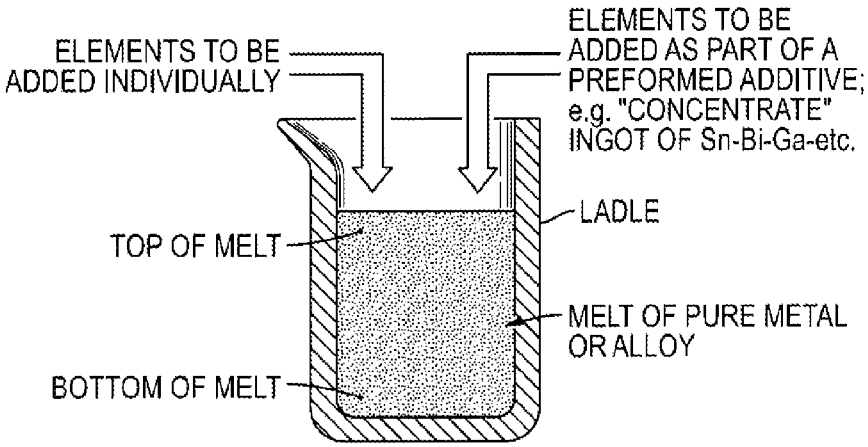
FIG. 3 shows a schematic illustrating a manufacturing method wherein additives according to embodiments are introduced to a metal melt. Alloying elements (metals) may be introduced in the additive either individually or as a mixture of different elements, as in the case where complex chemical compositions are to be produced.
Figure 4:
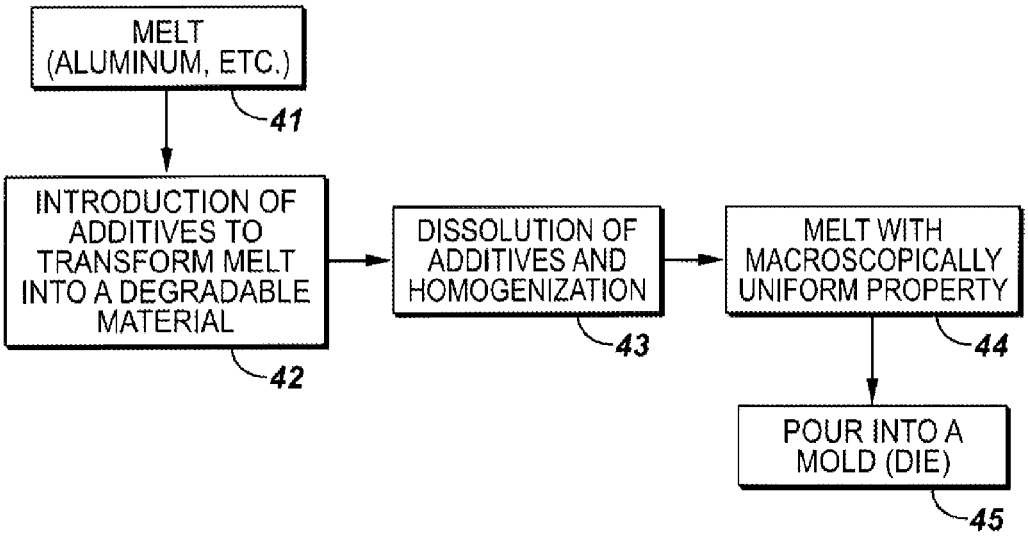
FIG. 4 shows a flow chart of a manufacturing method for casting degradable aluminum alloys in accordance with one embodiment.

FIG. 3 and FIG. 4 illustrate casting methods to prepare degradable alloys and products made of degradable alloys. For example, FIG. 4 illustrates a method for casting a product made of a degradable alloy. As shown, a melt is prepared (41), which may be a pure aluminum melt or an aluminum alloy melt (e.g., aluminum alloys 5086 or 6061). Then, additives (alloying products) are introduced to the melt (42) to change the chemical composition of the melt such that the resulting solid alloy (formed after cooling) is a degradable alloy. The additives (alloying products), for example, may be one or more of gallium (Ga), mercury (Hg), indium (In), bismuth (Bi), tin (Sn), lead (Pb), antimony (Sb), thallium (Tl) among other metals such as magnesium (Mg), zinc (Zn), or silicon (Si). The additives (alloying products) may be mixed homogeneously in the melt (43) via various stifling methods (e.g. mechanical, electromagnetic, etc) to create a melt with macroscopically uniform chemical compositions (44). This homogeneous melt may then be poured into a die (mould) to produce a product in the desired form or shape that is made of a degradable alloy (45). In some cases, the additives (alloying products) may be left in the melt without stirring to promote within the melt compositional gradients. In some cases, soon after mixing the gradient, chemical separation may occur wherein due to chemical incompatibility heavier elements might migrate toward the bottom of the melt, while lighter element might migrate to its top. Even though the entire melt, after solidification, will practically result in a number of alloys, the solid directly formed after casting is here considered as a single alloy. Certain parts of this alloy may be less degradable than others.

As illustrated in FIG. 3, the additives (alloying products) may be introduced (e.g., as powders, pellets, turnings, shots, etc.) individually to a melt of the base aluminum metal or aluminum alloy. Alternatively, multiple alloying elements (some or all of them) may be pre-made into a preformed additive serving as concentrate of alloying elements, which is then introduced into the base metal melt. The additives (part or all of the additives) may be premixed and melted to form an alloy ingot additive (i.e., a type of preformed additive), which is subsequently introduced into the base aluminum metal or aluminum alloy melt. Differently, multiple additives may be pre-made to form a compacted (pressed) solid additive of multiple elements (e.g. made from any prior-art powder metallurgy technique). This preformed additive is then introduced into a non-degradable melt to create after solidification a degradable alloy.

Inventive methods aim at altering the properties of pure aluminum as well as aluminum alloys, such as commercially available aluminum like 5086 or 6061 (two wrought grades) or 356 (a cast grade) to create degradable alloys. These methods may be performed at a supplier (manufacturer, vendor) location with minimum alterations to their existing processes. A supplier (manufacturer, vendor) being asked to manufacture a degradable alloy product as opposed to the same exact product of a non-degradable alloy may not see any change in its manufacturing process and does not to know the exact formulation of the additives. The use of additives can provide a useful means to alter the chemical composition of products without having to disclose confidential information of the formulation to a contract service provider.

As noted above, the additives (alloying products) may be conveniently introduced as powders, pellets, tunings, shots, etc., or as a preformed ingot or powder-compacted preform. However, some of the additives (e.g., gallium and mercury) are liquids at or near ambient temperature and require special shipping and handling precautions. For such liquid alloying products, one or more carriers (carrier products) may be introduced therein to force the formation of a solid additive that may be readily handled and deployed safely to a supplier (manufacturer) location. These carrier products may be either metallurgically bond with the alloying products (e.g., gallium), and/or they may be infiltrated by the alloying products so that these alloying products may be convenient handled as solid additives. Such alloying product—carrier mixtures may be pulverized, crushed, machined, ground to fine pieces to provide alloying products in the forms of powders, pellets, turnings, shots, etc. Alternatively, the alloying product, along with their carrier, may be made into solid preformed additives like ingots.

For example, a solid preformed additive containing gallium (Ga) that is to be used as a concentrate of alloying products may be produced by adding one or more carrier products. Carrier products suitable with gallium (Ga) include, for examples, lithium (Li), magnesium (Mg), and nickel (Ni), among others. Other carriers may simply consist of mixtures, for instance tin (Sn) and zinc (Zn). Tin (Sn) and gallium (Ga), when combined stabilize the liquid phase a lower temperatures, but if additional elements are added in sufficient quantity such as zinc (Zn), among others, a new solid material containing gallium (Ga) will result. This new material may be utilized as solid performed additives. Preformed additives (made of metals and alloys) may therefore have complex chemical compositions, but once incorporated in the hot metal or alloy melt to form the degradable alloy they may decompose to properly alloy with the melt and therefore create a degradable alloy. It is to be noted that the carrier element influences the property of the resulting degradable alloys. However, they are considered carrier products because they are not responsible for making the alloy degradable; instead they influence other properties (e.g. density, strength, et).

Figure 5A:
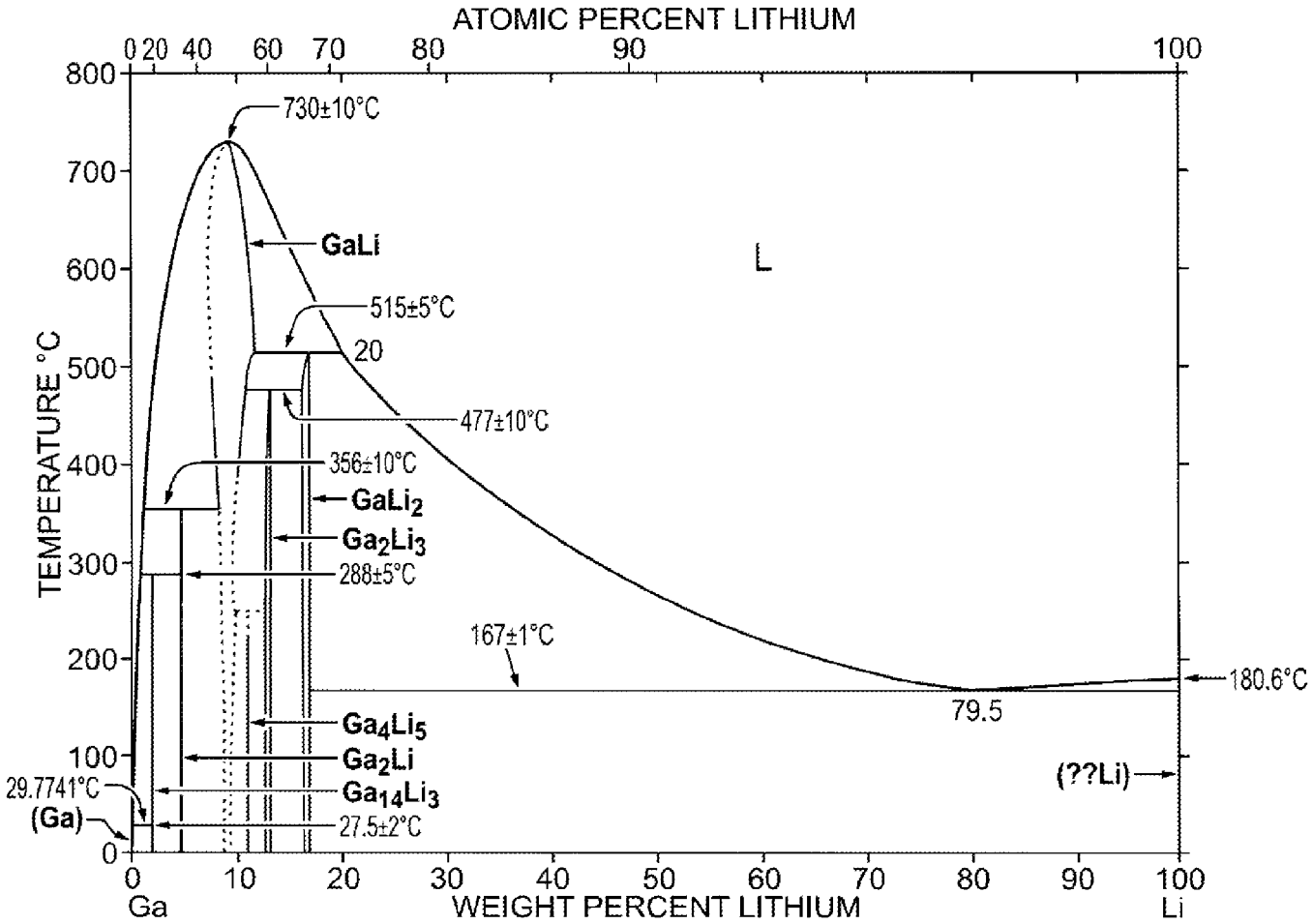
FIGS. 5A-5D show binary-phase diagrams of gallium with other selected metals.

FIG. 5A shows a Ga—Li phase diagram. As shown in this phase diagram, it takes only a few percent of lithium (Li) to cause the melting temperature of a Ga—Li mixture to rapidly increase. This observation indicates that lithium (Li) may be a highly effective carrier product for gallium (Ga). FIG. 5A shows that adding about 2.5 wt. % lithium (Li) in gallium (Ga) stabilizes a solid phase; in other words with only 2.5 wt. % lithium (Li), the liquid gallium is made into a solid, and this solid will decompose a temperature that is significantly lower than the casting temperatures of the degradable alloys.

Figure 5B:
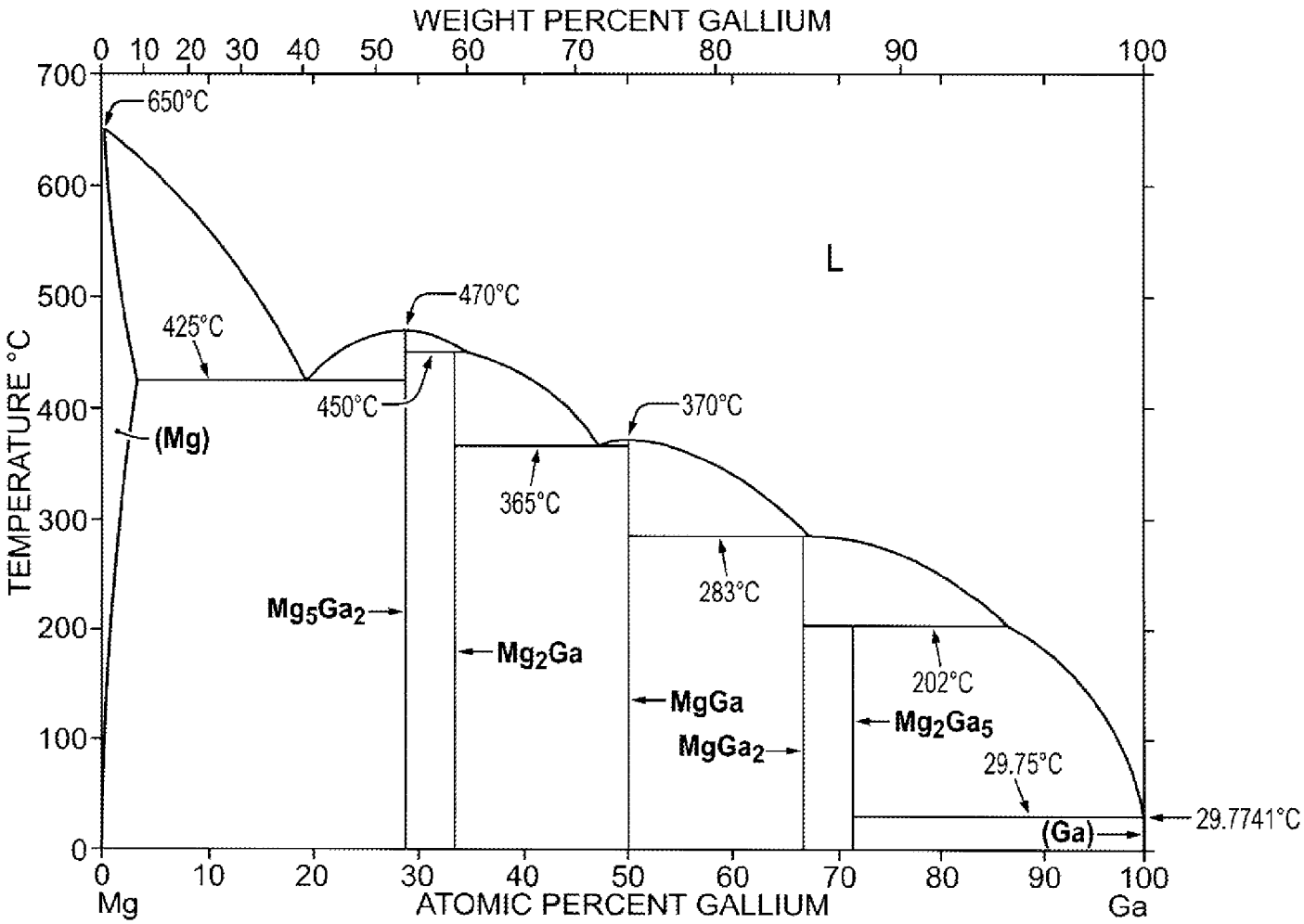
Figure 5C:
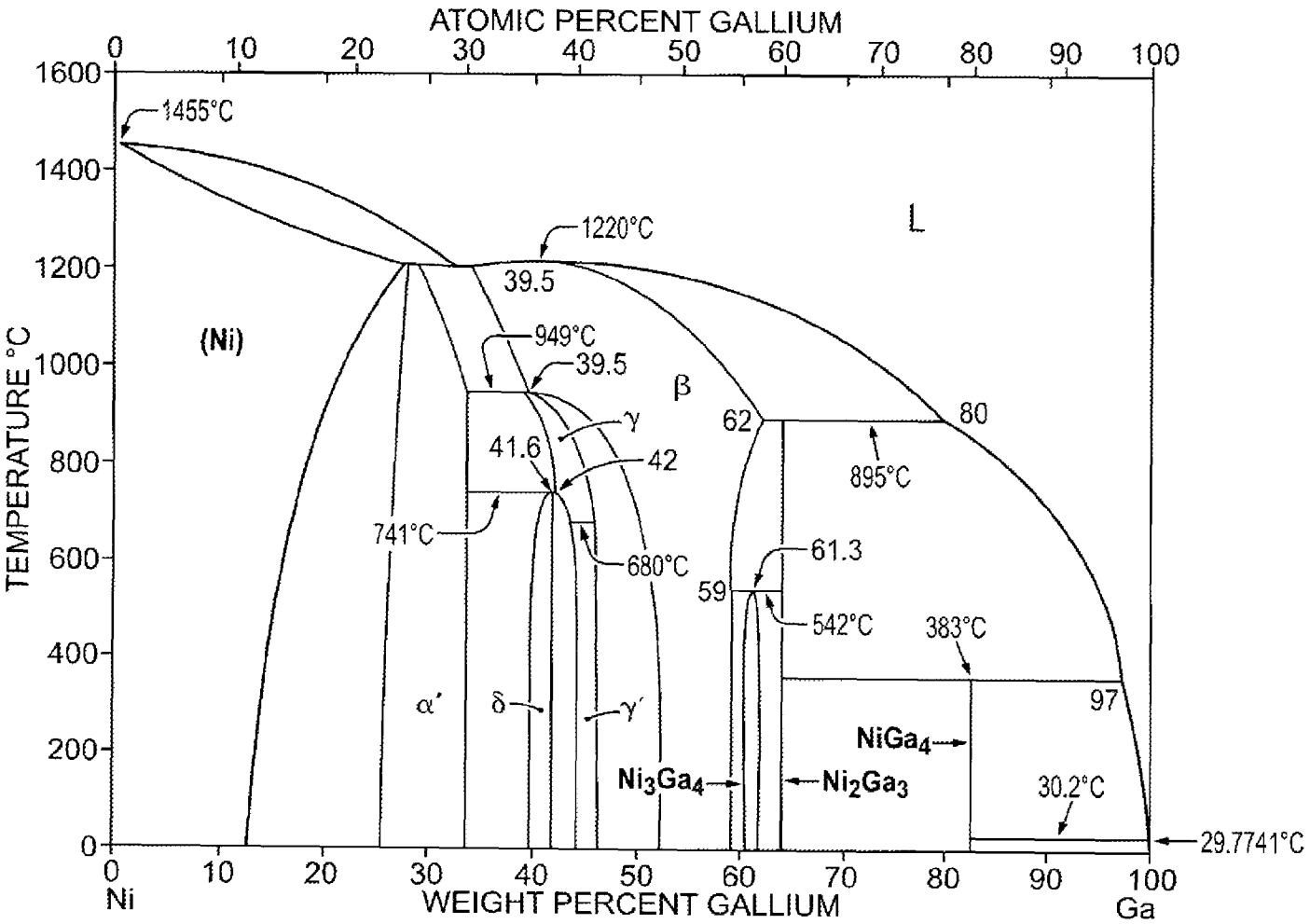

Similarly, FIG. 5B shows an Mg—Ga phase diagram, and FIG. 5C shows a phase diagram of Ni—Ga. Although magnesium (Mg) and nickel (Ni) are less effective than lithium (Li), they nevertheless have similar effects of raising the melting temperatures of the Mg—Ga and Ni—Ga mixtures. FIGS. 5B-5C show that about 13 wt. % magnesium (Mg) in gallium (Ga) creates a solid phase; comparatively about 22 wt. % nickel produces the same effect, while only 2 wt. % lithium (Li) was needed to create a solid material. Decomposition of any of the formed phase is still satisfactory as none of these phases are stable at degradable alloy casting temperature.

Figure 5D:
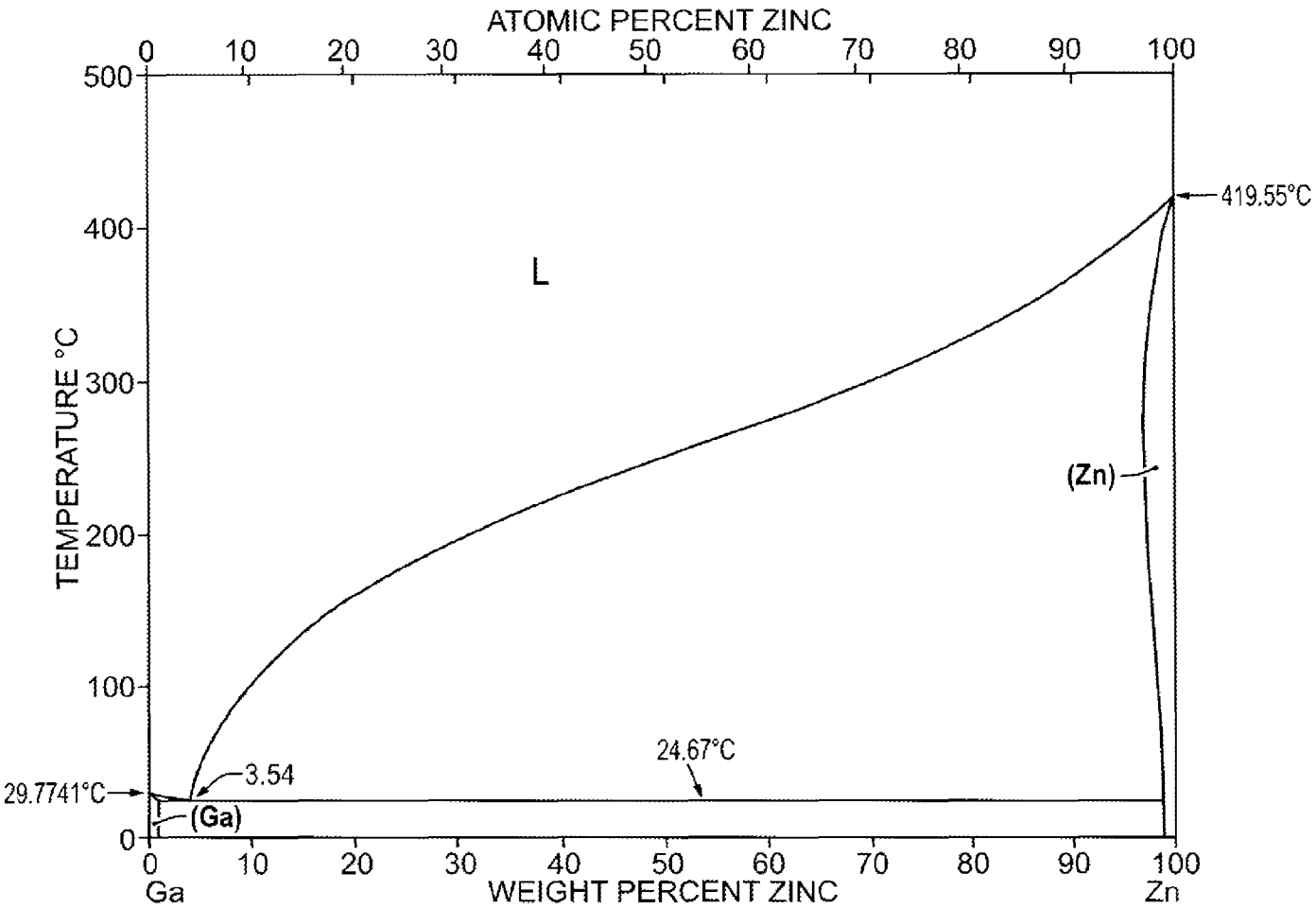

FIG. 5D shows a Zn—Ga phase diagram, which indicates zinc (Zn) may not form intermetallic phases with gallium (Ga), but may be infiltrated by gallium (Ga). Thus, zinc (Zn) may also be used as a gallium (Ga) carrier, though far less effective than lithium (Li), magnesium (Mg), or (Nickel). Note that lithium is especially reactive, and its use creates handle-ability, shipping and procurement issues.

Other embodiments include preformed additives of metal and alloys, wherein the metal and alloys are physically contained (dispersed, encapsulated, wrapped, etc) within non-metals; for instance a polymer. This encapsulating non-metallic material carrier, upon contact with the hot melt of aluminum or aluminum alloy, fully degrade and do not negatively impact the properties of the solidified melt. Plastics are degraded (burnt) at aluminum casting temperature and may be used as non-metallic carriers.

As illustrated in FIG. 4, the additives (alloying products) and the base metal melt may be mixed to produce homogeneous mixtures, which are then poured into a die or mould and allowed to solidify to form a degradable alloy. In accordance with some embodiments, however, the added alloying products and the base-metal melt are not mixed to produce homogeneous solidified alloys. Instead, the addition of the alloying products may be controlled in a fashion to produce degradable alloys having gradients of the alloying products (i.e. to form a graded material or alloy). With a gradient of the alloying products present within a degradable alloy, the properties (e.g., degradability) of the degradable alloy will differ from locations to locations. Such a degradable material or element having for instance a graded structure near its surface (e.g. a skin) that is barely degradable, but a core that is degradable, may be advantageous as this so-called skin may serve as natural delay to the full degradation of the material or element, and may substitute temporary protective surface treatments and coatings.

To achieve the desired properties and homogeneity levels within the degradable alloy, for instance one could mix the melt thoroughly with the alloying products (additives) and controllably cool and solidify the aluminum plus alloying element melt. In cases and depending upon the alloying elements within the melt and their partitioning with the melt, rapid cooling may be foreseen to create compositional homogeneity, whereas with other alloying compositions rapid cooling may be used to form compositional gradients within the solidified melt. For instance, with those alloying elements having substantial solubility in solid aluminum and partitioning to great extents during solidification, rapid cooling (as produced by selected heat extraction in selected directions for instance) may be generally used to insure the formation of a graded material. Differently, for alloying elements being non-soluble in the melt and having very different densities, a slow cooling may be used to facilitate the formation of a graded material (i.e., a material or alloy with compositional gradients). It is apparent that appropriate melting and cooling practice will depend on the melt composition and whether the chemical composition of the melt is to be purposely redistributed as in a graded alloy or not.

Figure 6A:
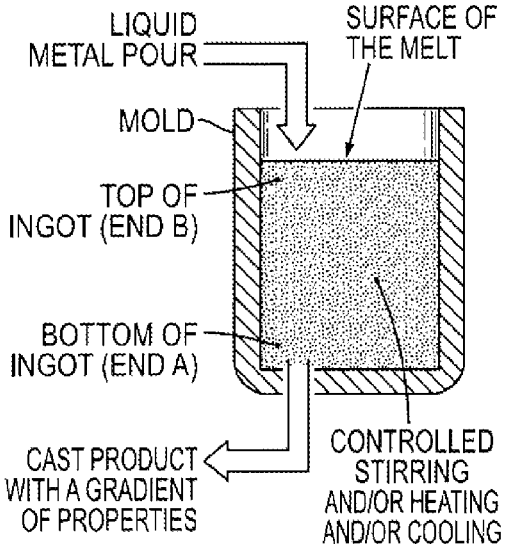
FIG. 6A shows a schematic of a manufacturing method according to embodiments for making a material or product having either a homogeneous or a graded chemical composition (i.e., with gradients). Depending upon initial melt composition, alloying elements, rates of solidification, and rates of cooling, the chemical composition of the degradable alloy or product may be distributed to offer a variety of useful properties.

In instances where small quantities of tin (Sn) and bismuth (Bi) are added to the melt, to achieve a graded material, one could cool the melt slowly and controllably to allow the redistribution of the alloying products within the melt. For example, FIG. 6A shows a schematic illustrating a method using slow cooling (solidifying) processes to create a gradient of the alloying products (e.g., ting, bismuth, lead) in a melt that has been poured in a dye or mould.

Figure 6B:
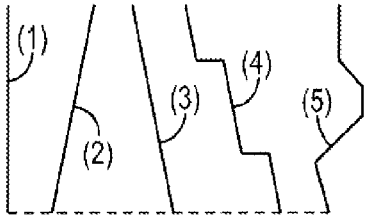
FIG. 6B depicts a diagram illustrating different variations of properties within a degradable alloy that may be formed in accordance with embodiments. An alloy having a distributed chemical composition is considered as being an alloy; it may also be considered as a material incorporating a variety or chemical compositions or alloys. No distinction is herein made as the material will simply be referred as an alloy.

The rates of cooling and solidifying, along with different mixing methods of the alloying products, may be controlled in a desired fashion to achieve different gradient patterns. FIG. 6B shows some examples of gradient distributions along the vertical axis of a cast that might be achieved using methods described herein: (1) constant property (or zero gradient), (2) linearly decreasing/increasing property (or constant gradient), (3) property change marked by discontinuities, and (4) miscellaneous.

Powder Metallurgy

In addition to casting methods, wherein a melt of a degradable alloy is poured into a mould or die (possibly having the final shape or a near-net shape of the intended product), some embodiments employ powder-metallurgy (PM) techniques. With powder-metallurgy techniques, small solids and/or powders (instead of melts) of metals and alloys are compacted under pressure to form solid materials (including alloys) and products with final or near-final dimensions. By definition a powder is a solid, and with some of the low-temperature metals (e.g. gallium is liquid at ambient temperature), no powder is available. Novel methods to create powders from additives to a non-degradable metal or alloy are therefore disclosed.

Powders and fine piece of degradable alloys may be produced by mechanical grinding, pulverizing, atomizing solid degradable alloys (such as ingots) and degradable alloy melts (droplets). For example, an alloy ingot comprising aluminum (Al), bismuth (Bi), tin (Sn), and gallium (Ga) may be prepared and pulverized into fine powders before using this material in powder-metallurgy processes, such as pressing (including hot-isostatic pressing or HIP) and sintering. The fine grinding of a degradable alloy may also be applied to form fine solid powder of the degradable alloy.

In accordance with embodiments, powders of low-melting temperature additives may be produced by alloying the low melting-temperature additives with other products to raise their melting (solidus and liquidus) temperatures. For example, gallium (Ga) is liquid at or near-room temperature. As previously noted, gallium (Ga) may be properly alloyed with lithium (Li), magnesium (Mg), nickel (Ni), or zinc (Zn) to convert it into a solid alloy, as shown in FIGS. 5A-5D. These gallium (Ga) alloys may then be reduced to powder for subsequent powder-metallurgy methods (compacting). Similarly, other metals that are otherwise liquids may also be converted into solids with a carrier metal in order to prepare powders for use with embodiments.

In accordance with an embodiment, a product or part in near-net shape (e.g. a dart/plug, shaped-charge case, tubular, etc.) may be produced by sintering of the above-mentioned degradable alloy powders using methods that employ powder-metallurgy techniques, including pressing and sintering.

In accordance with some embodiments, metal powders that are individually non-degradable may be mixed, pressed, and sintered to produce a final product that is degradable. For example, non-degradable aluminum powder and one or more of alloying product powders (e.g., gallium, bismuth, tin, etc) may be mixed and pressed into a near-final shape of a desired product, followed with high-temperature treatment (sintering) to produce a solid and bonded product that is degradable under selected conditions.

In accordance with some embodiments, a degradable alloy (in the powder form) may be mixed with other metals or non-metallic materials (such as ceramic) to form a composite material, which may be pressed and sintered to produce a product that is still degradable and have some other desired properties conferred by the other materials (such as ceramic). In some embodiments, powders of refractory products (such as carbon, silicon, tungsten, tungsten carbide, etc.) may be introduced, particularly to modify density of the degradable material and/or product, among other properties. These powders may be mixed, pressed, and sintered to produce products of a final shape or a near final shape.

Forming and Forging (Cold or Hot Working)

In accordance with some embodiments, the degradable products from casting or powder-metallurgy techniques may be further treated with metal working methods (including forging) that are commonly used in the art.

For example, the degradable alloys may be cold worked before heat-treating to produce fine grain structures and/or to homogenize the alloys. Similarly, the degradable alloys may be cold worked to increase their strengths. For example, a cold-worked tubing may produce a 50-ksi tubular product, as for instance demanded by a perforating gun carrier.

Hot working may also be used to remove internal defects, such as casting voids (in particular shrinkage voids due to the presence of special alloying products), in the degradable alloys. Thus, hot-working (forging) may be used to improve the properties (such as density) of a degradable metallic material.

Coating and Surface Treatments

In a similar manner, coating (deposition) techniques that are commonly used in the industry may be used to create or improve a product having degradability. Examples include deposition of degradable alloys onto a non-degradable material via processes such as weld overlaying. Coating may also be applied to casting or powder-metallurgy products to provide protective layers on these products. Such coating may be used to delay the degradation of the degradable materials. Similarly, surface e treatments may be applied to control surface degradability of a degradable alloy. For example, selected techniques (e.g. etching, diffusion, etc) may be used to selectively modify the surface of a degradable alloy.

In accordance with some embodiments, coating (deposition) techniques may be used to build up a product in a final shape or a near-net shape layer by layer, using degradable materials alone or using the degradable materials on a base substrate made of a non-degradable material (such as a ceramic or a composite).

The products made by methods according to embodiments may be in the final shape ready for use. Alternatively, they may be parts of a larger element. In this case, further assembly of the parts having degradable alloys may be performed to produce the final elements. The assembly may include welding these parts together or welding the part to a larger element.

FIGS. 7-10 show some examples of oilfield elements that might benefit from using degradable alloys in accordance with embodiments.

Figure 7:
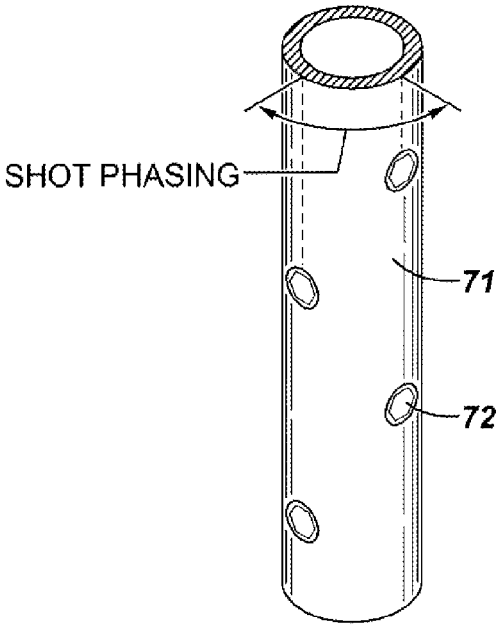
FIG. 7 shows a tubular product, e.g., a gun carrier, containing degradable alloys in accordance with one embodiment.

FIG. 7 shows a tubing 71, which may be a gun carrier, for perforation operations. The gun carrier tubing 71 may have several removable charge carrier 72 dispose thereon. After perforation operation, the gun carrier tubing 71 may be allowed to degrade, if it is made of a degradable alloy. The use of a degradable alloy gun will avoid the need for its retrieval after perforating.

A tubular product as shown in FIG. 7 may be manufactured by, for example, casting, including centrifugal casting, forging and forming (extrusion or flow forming) of a product made of a degradable material. Alternatively, such a product may be made with powder metallurgy techniques previously described. Coating and surface treatments may also be optionally applied.

Figure 8:
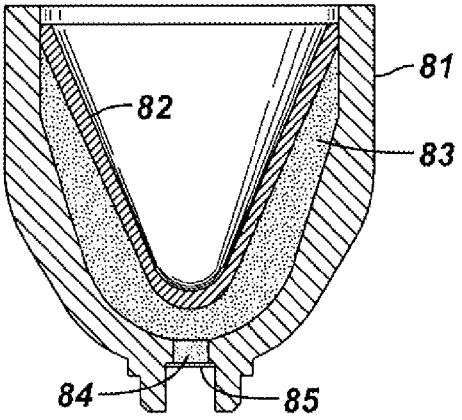
FIG. 8 shows a shaped-charge case containing degradable alloys in accordance with one embodiment.

FIG. 8 shows a shaped-charge comprising a metal casing 81, a liner 82, main explosive 83, explosive (fuse) 84 and a metallic dot (or cup) 85. After firing the explosives 83 and 84 are spent and the liner 82 is projected into the formations. The casing 81 is left behind. If the casing 81 is made of a degradable material, it may be allowed to degrade so that it would not interfere with subsequent oilfield operations.

Figure 9:
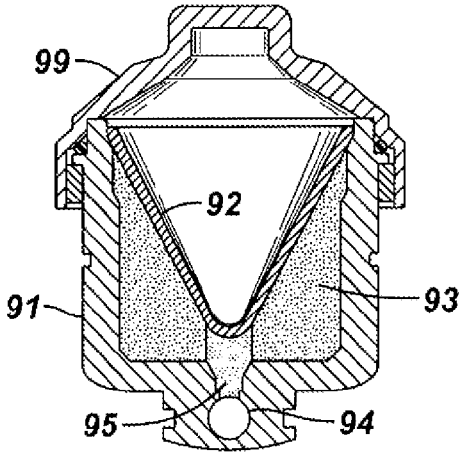
FIG. 9 shows an encapsulated shaped-charge case containing degradable alloys in accordance with one embodiment.

FIG. 9 shows another embodiments of a shaped-charge having a casing 91, a liner 92, main explosive 93, fuse explosive 95 disposed near a primer hole 94, and a cap 99. Again after firing, the casing 91 and the cap 99 is left behind. It may be desirable to have the casing 91 and the cap 99 made of a degradable alloy so that these remaining parts do not interfere with the subsequent oilfield operations.

Figure 10:
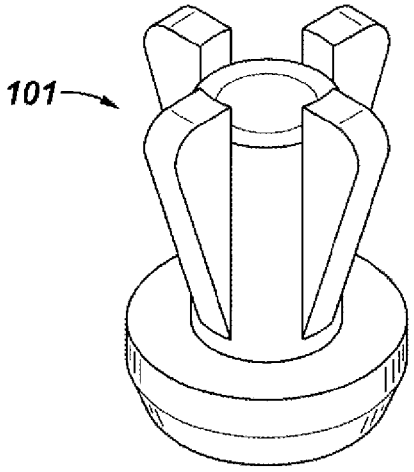
FIG. 10 shows a downhole dart containing degradable alloys in accordance with one embodiment.

FIG. 10 shows a treat and produce (TAP) dart. The type of dart is released downhole to provide a temporary zone isolation. After serving its function, this element is degraded so that it does not interfere with subsequent oilfield operations. In accordance with embodiments, the dart body 101 may be made of a degradable alloy.

The shaped charges shown in FIG. 8 and FIG. 9 and the TAP dart shown in FIG. 10 may be manufactured by casting, powder metallurgy routes, or forming with extrusion or drawing for instance. The initial products may also be further treated with coating, surface treatments, welding and joining processes, among other processes.

Advantages of embodiments may include one or more of the following. Methods may provide degradable oilfield elements that may be degraded after the objectives of using these oilfield elements have been achieved without restricting future operations in the wellbore. Embodiments can also be readily adaptable to equipment that is currently used in making these elements. Modifications of the existing methods are straightforward. Some of these methods may be performed by the vendors (suppliers/manufacturers) at their current facilities with minimal modifications to their procedures.

While various examples have been described with respect to a limited number of embodiments, those skilled in the art, having benefit of this disclosure, will appreciate that other embodiments may be devised which do not depart from the inventive scope as disclosed herein. Accordingly, the scope of the present and any future claims should not be unnecessarily limited by the present application.

What is claimed is:

1. A method for manufacturing a degradable gun carrier, comprising:

placing powders of a base metal or a base alloy and powders of one or more alloying elements selected from the group consisting of as gallium, indium, zinc, and bismuth in a gun carrier tubing mould, wherein the base metal or the base alloy is aluminum or aluminum alloy; and pressing and sintering the powders to form the gun carrier.

2. The method of claim 1, wherein the powders of the base metal or the base alloy and the powders of the one or more alloying elements are pre-mixed before the placing in the mould.

3. The method of claim 1, further comprising placing powders of a non-metallic material in the mould before the placing and the sintering.

4. The method of claim 3, wherein the non-metallic material comprises ceramics.

5. The method of claim 1, wherein the powders of the one or more alloying elements is selected because it will render the gun carrier degradable in water.

6. The method of claim 1, wherein the powders of the one or more alloying elements is selected because it will render the gun carrier degradable in fluid having a pH greater than 7.0.

7. The method of claim 1, wherein the powders of the one or more alloying elements is selected because it will render the gun carrier degradable in fluid having a pH less than 7.0.

* * * * *